United States Patent [19]

Manabe et al.

[11] Patent Number: 4,806,109

[45] Date of Patent: Feb. 21, 1989

[54] SHIELDED ELECTRICAL CONNECTOR

[75] Inventors: Sakae Manabe, Kanagawa; Takashi Kamono, Yokohama; Tetsuro Tokaichi; Shoji Umesato, both of Tokyo, all of Japan

[73] Assignee: AMP Incorporated, Harrisburg, Pa.

[21] Appl. No.: 148,465

[22] Filed: Jan. 26, 1988

[51] Int. Cl.[4] ..... H01R 4/66

[52] U.S. Cl. ..... 439/108; 439/607

[58] Field of Search ..... 439/92, 101, 108, 607, 439/608

[56] References Cited

U.S. PATENT DOCUMENTS 4,215,910 8/1980 Walter ..... 439/608

4,232,929 11/1980 Zobawa ..... 439/607

FOREIGN PATENT DOCUMENTS 2027290 7/1979 United Kingdom .

OTHER PUBLICATIONS

PCT Search Report.

PCT Search Report Annex.

*Primary Examiner*—Gary F. Paumen

*Attorney, Agent, or Firm*—William B. Noll; David L. Smith

[57] ABSTRACT

A shielded electrical connector comprises a housing having contact sections of electrical contact members disposed in passages of the housing and exposed terminal sections extending outwardly and downwardly from a rear surface of the housing for electrical connection with signal paths of a printed circuit board. A shield plate extends along a row of terminal sections and has ground terminals electrically connected to ground tabs of contact members and ground terminals for electrical connection with ground paths of the printed circuit board.

4 Claims, 3 Drawing Sheets

SHIELDED ELECTRICAL CONNECTOR

FIELD OF THE INVENTION

This invention relates to an electrical connector and more particularly to a shielded electrical connector that has a shield plate disposed along exposed terminal sections of electrical contact members that extend outwardly from a housing.

BACKGROUND OF THE INVENTION

Electrical connectors with a large number of electrical contacts are often used in electrical computers, particularly large computers which produce a high number of transmission signals. One example of a known connector will be described with reference to FIG. 7. This connector comprises a first connector 1 which holds many plug contacts 2 in a receptacle housing 3, and a second connector 5 which also has many receptacle contacts 8 held within plug housing 6. Plug contacts 2 in the first connector 1, are disposed in multiple rows in receptacle housing 3, each row containing plug contacts 2 arrayed laterally. The plug housing 6 in the second connector 5 has multiple rows of receptacle contacts 8, corresponding to the array of plug contacts 2. When plug housing 6 is mated with receptacle housing 3, the plug contacts 2 electrically mate with corresponding receptacle contacts 8. The other end of the receptacle contacts 8 are exposed and protrude from the back of plug housing 6 and are bent downward as shown in FIG. 7 as multiple rows of terminal sections **8*a* which are maintained in parallel rows by the retaining plate 7**.

Use of this type of connector permits a high number of transmission signals using a small connector. However, because the exposed sections of the receptacle contacts 8 in the second connector 5 protrude externally from the plug housing 6, and further because the spacing between the receptacle contacts 8 has been reduced in response to a requirement to increase the number of transmission signals, crosstalk is generated between the adjoining contacts thereby resulting in the possibility of noise faults occurring. The chances of crosstalk being generated and thus the risk of noise faults, increase with the higher transmission signal speeds made possible by the larger capacity and better performance of computers.

SUMMARY OF THE INVENTION

According to the present invention, a shielded electrical connector prevents the generation of crosstalk and eliminates the risk of noise faults occurring.

The shielded connector of this invention comprises rows of contact sections of contact members retained in a housing. A shield plate is covered by a layer of insulation and is positioned between the rows of exposed terminal sections of the contact members which protrude in rows from the housing. One end of this shield plate has a ground junction terminal which is electrically connected to a ground connecting portion of the contact member which is grounded. The other end of the shield plate has a terminal member to be connected to the ground plane of a printed circuit board.

A connector constructed in the manner described above prevents the occurrence of noise by intercepting the crosstalk between the rows of contact members using a grounded shield plate positioned between the exposed terminal sections of the contact members which protrude from the housing.

DETAILED DESCRIPTION OF THE INVENTION

An embodiment according to the present invention will be described by way of example with reference to the accompanying drawings.

Figure 1:
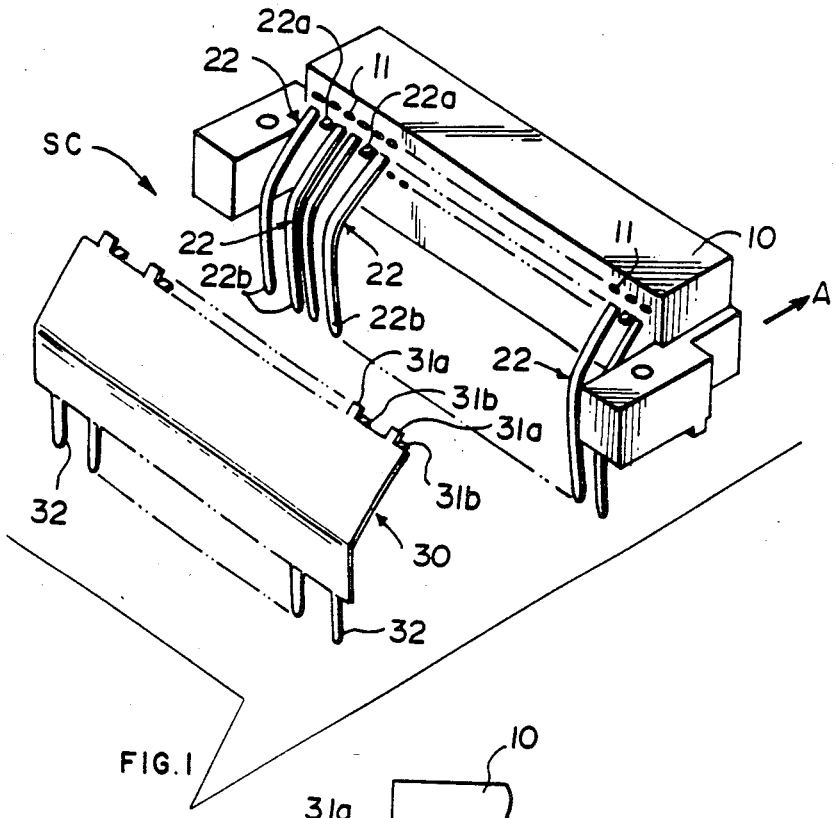
FIG. 1 is an exploded perspective view of the multiple shielded connector according to the present invention showing only the second row of contact members.
Figure 2:
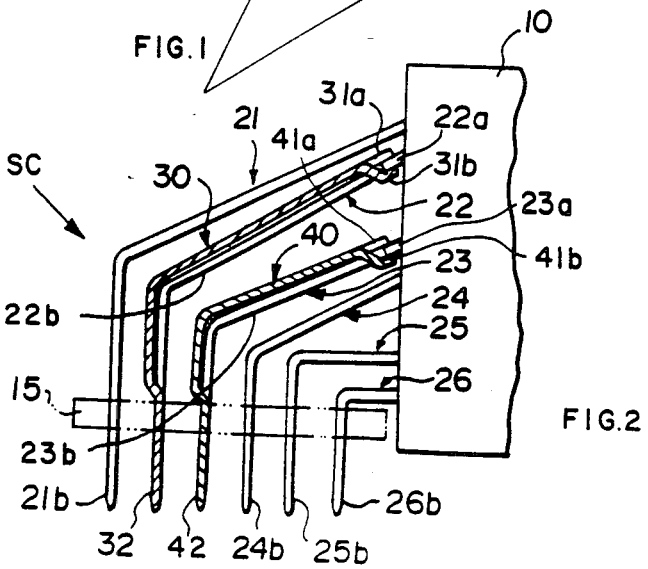
FIG. 2 is a side view partly in cross-section of the shielded connector according to the invention.

FIG. 1 shows shielded connector SC of this invention in which only the second row of electrical contact members 22 are shown. Shield 30 as shown in FIG. 2 extends along the upper surfaces of the second row of contact members 22. The dielectric housing 10 includes a plurality of contact passages (not shown) arranged in rows and opening at the front surface, indicated by the direction of arrow A, and contact sections (not shown) of the contact members 22 are accommodated in the contact passages.

In addition, many small holes 11 in multiple rows as part of the above contact passages extend through the rear surface of housing 10. The terminal sections **22*b* of the contact members 22 protrude through the small holes 11 at the rear surface of housing 10 in a slanted manner downwards and backwards, and are bent downwards in the middle so as to be substantially parallel to the rear surface of housing 10 for electrical connection with signal paths on a printed circuit board (not shown). However, some of the contact members 22 are grounding terminal sections so that the contact sections thereof are electrically connected to mating ground electrical contacts, and they are cut short as indicated in FIG. 1 forming ground tabs 22*a* extending outwardly from the rear surface of housing 10 in the same angular direction as that of terminal sections 22*b*** as well as being in alignment therewith.

Shield plate 30 comprises a metal plate which is bent to the shape of the terminal sections **22*b* and which has its surfaces coated with an insulating material, such as polymid. The upper end of shield plate 30 includes pairs of first ground terminals 31*a* and second ground terminals 31*b*, in alignment with the ground tabs 22*a*. The bottom end of shield plate 30 has third ground terminals 32 which protrude downwards and are in alignment with the respective pairs of ground terminals 31*a* and 31*b*. First ground terminals 31*a* and second ground terminals 31*b*** are bifurcated.

When the shield plate 30 is placed on top of terminal sections **22*b* of the second row of contact members 22, the respective ground tabs 22*a* are disposed between bifurcated ground terminals 31***a*,31*b*, and the ground terminals 32 are aligned with the terminal sections 22*b*. Ground terminals 32 are used in place of the missing terminal sections of the shortened ground tabs 22*a*. The ground terminals 31*a*,31*b* and the ground terminals 32 of the shield plate 30 are not coated with insulating material.

When the shield plate 30 is mounted on the terminal sections 22*b* of the second row of contact members 22, and the ground tabs 22*a* are fitted between the first and second ground terminals 31*a* and 31*b* are soldered together, the ground tabs 22*a* are electrically connected with the shield plate 30. Therefore, the shield plate 30 can be grounded by connecting the ground terminals 32 to the ground path or paths of a printed circuit board (not shown), and thus crosstalk between adjacent rows of the contact members can be prevented. Also, crosstalk between adjacent contact members in each row is eliminated by grounding several contact members as shown in FIG. 1.

The above describes the mounting of a shield plate on the second row of contact members of an electrical connector. FIG. 2 shows the connector having shield plates mounted in a similar manner on two rows of the contact members. The connector has six rows of contact members 21–26 in the housing 10. The terminal sections 21*b*–26*b* of each row of contact members 21–26 extend downwards and are held in place by a dielectric retaining plate 15 which prevents displacement of the terminal sections. In the connector, the shield plates 30 and 40 are respectively mounted on the upper surfaces of the second row of contact members 22 and the third row of contact members 23. The upper ends of shield plates 30,40 are electrically connected to ground tabs while ground terminals 32,42 are electrically connected to ground paths on the printed circuit board. The shield plates 30 and 40 prevent crosstalk being generated between the first and second rows of contact members 21,22 and the second and third rows of contact members 22,23 respectively.

Figure 3:
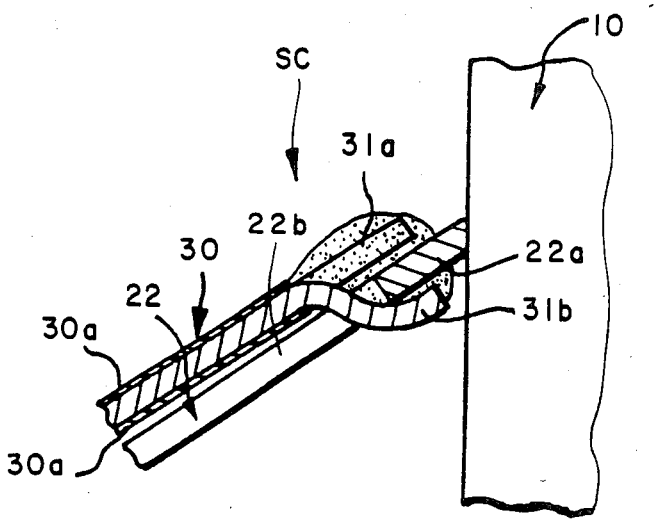
FIG. 3 is a part side view partly in cross-section showing an enlargement of the attachment of the shield plate to the ground tabs of the contact members of the connector.

FIG. 3 shows ground tab 22*a* disposed between the bifurcated first and second ground terminals 31*a* and 31*b* at the upper end of shield plate 30 with ground tab 22*a* being soldered in place. The surface of shield plate 30 is coated with an insulating material 30*a* such as polymid except for the first and second ground terminals 31*a* and 31*b* and the ground leg 32. Shield plate 40 is also connected in the same manner as sheld plate 30.

Figure 4:
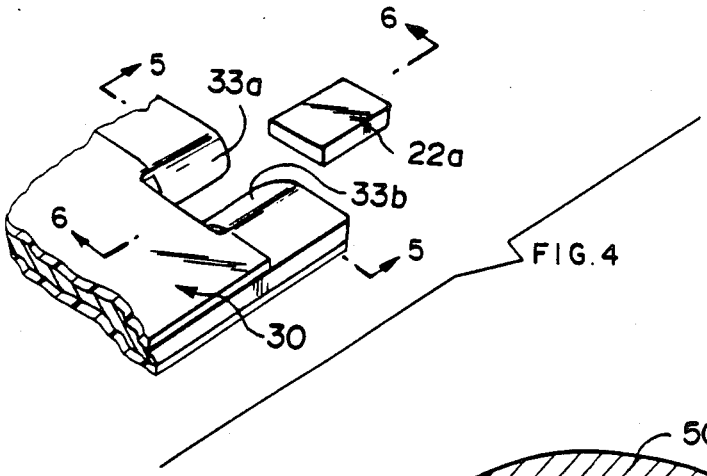
FIG. 4 is a part perspective view of an alternative shield plate.
Figure 5:
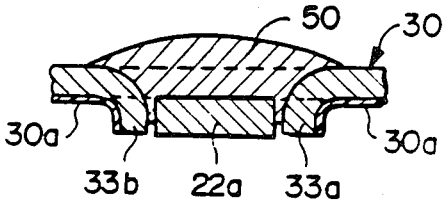
FIGS. 5 and 6 are part cross-sectional views of the shield plate attached to the ground tabs, taken in the directions indicated in FIG. 4 by the lines V—V and VI—VI.
Figure 6:
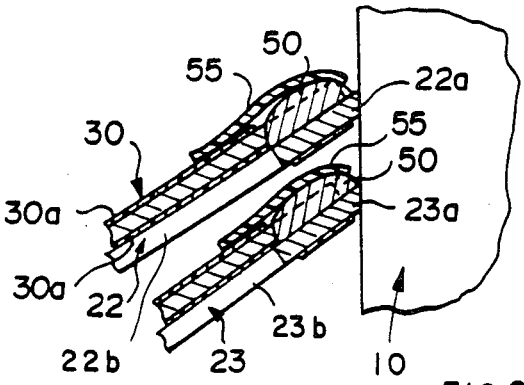
Figure 7:
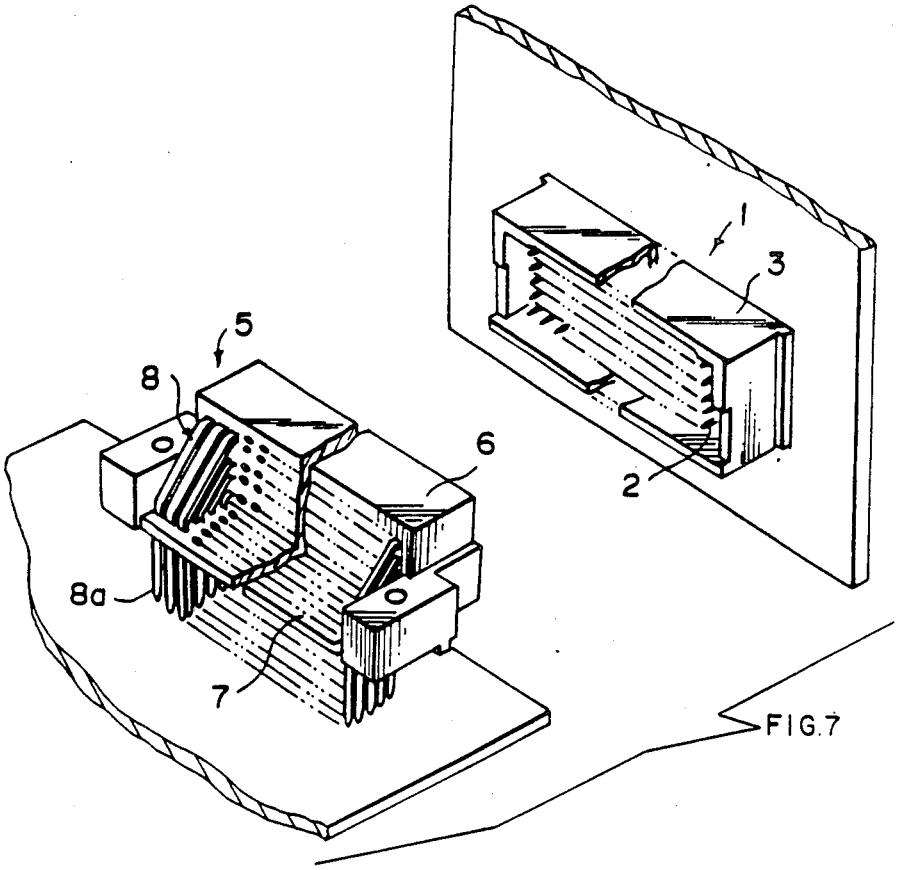
FIG. 7 is a perspective exploded view of conventional matable electrical connector.

FIG. 4 shows a perspective view of another embodiment of a connection between shield plate 30 and ground tab 22*a*. In this embodiment T-shaped cuts are made in the upper end of shield plate 30 forming sections 33*a*,33*b* which are then bent downwardly as shown in FIG. 5 to form arcuate ground terminal sections 33*a*,33*b*. When ground tab 22*a* is positioned between ground terminal sections 33*a*,33*b* and soldered thereto by solder 50, the connection is shown in FIGS. 5 and 6 respectively. Therefore, the insulating coating 30*a* on the surface of the shield plate 30 does not cover the surfaces of ground terminal sections 33*a*,33*b* to be soldered to ground tabs 22*a*. Thus, as shown by FIG. 6, the upper surface of solder 50 should be covered with insulation tape 55. The above-described embodiments disclose the positioning of a shield plate on the upper surfaces of a row of terminal sections of electrical contact members, however other ways to position shield plates on electrical contact members are possible.

As disclosed above, this invention is such that crosstalk generated between rows of terminal sections of contact members prevent the occurrence of noise faults, through the use of a grounded shield plate which is positioned between rows of terminal sections arrayed in rows and protruding externally from their housing.

We claim:

1. A shielded electrical connector, comprising:

a dielectric housing having rows of contact-receiving passages extending therethrough;

a plurality of electrical contact members having contact sections disposed in said contact-receiving passages and exposed terminal sections extending outwardly in rows from a rear surface of said housing for electrical engagement with signal paths of a printed circuit board;

a shield plate having an insulation layer covering the exterior surfaces thereof and disposed along one of said rows of terminal sections to eliminate noise faults between and among certain contact sections, where selected said contact members of said one row include ground tabs, said shield plate including along an upper edge thereof ground terminals each aligned with and connected to a said ground tab, and at the lower end thereof a like plurality of ground terminals aligned with and electrically connected to a said ground path of said printed circuit board, whereby said selected contact members are isolated from the remaining contact members of said shielded electrical connector such that noise faults are eliminated between said remaining contact members in said one row.

2. A shielded electrical connector as claimed in claim 1, wherein said ground tabs comprise opposed arcuate ground terminal sections between which said ground tabs are disposed.

3. A shielded electrical connector as claimed in claim 1, wherein said terminal sections are bent forming slanted portions that extend downwardly and linear portions that extend parallel to said rear surface of said housing.

4. A shielded electrical connector as claimed in claim 1, wherein the terminal sections are disposed in a retaining plate holding them in place.

* * * * *